US005542708A

United States Patent [19]

Primlani

[11] Patent Number: 5,542,708

[45] Date of Patent: Aug. 6, 1996

[54] PAPER, LEAF AND LAMINATE BINDER

[76] Inventor: Indru J. Primlani, 2616 NE. 19th St., Renton, Wash. 98056

[21] Appl. No.: 248,424

[22] Filed: May 24, 1994

[51] Int. Cl.[6] ..... B42D 1/00

[52] U.S. Cl. ..... 281/21.1; 281/15.1; 281/28; 281/36

[58] Field of Search ..... 281/15.1, 21.1, 281/28, 51, 36, 29; 402/80, 73

[56] References Cited

U.S. PATENT DOCUMENTS

| | | | |
|---|---|---|---|
| 3,628,877 | 12/1971 | Barnes | 402/80 R X |
| 4,842,435 | 6/1989 | Thomas et al. | 402/80 R |
| 4,865,483 | 9/1989 | Snook | 402/80 R |

*Primary Examiner*—Willmon Fridie, Jr.
*Attorney, Agent, or Firm*—David L. Tingey

[57] ABSTRACT

A versatile binder for binding leaf materials, including sheets of paper as well as carpet samples, is provided with a bellows between legs of a binding bracket for adjustment in receiving differing thicknesses of materials to be bound. The bellows is actuated with a manual air pump mounted on the binding bracket under a bladder. A torsion spring-biasing binding clamp is further provided to secure the bound materials in place once the bellows have been positioned. An alternative binding clamp is provided in one or more tapered pins on an upper bracket member matching frustum bores in blocks mounted to lower bracket members, frictionally.binding the two members together when the tapered pins are urged into the frustum bores.

8 Claims, 5 Drawing Sheets

PAPER, LEAF AND LAMINATE BINDER

BACKGROUND OF THE INVENTION

This invention relates in general to binding a range of sizes of leaves of many materials so that they can be carried and dissembled with ease, and in particular to bind papers, reports etc.

Documents are presently bound with a large number of plastic or metal finger brackets or are spiral bound. Some reports are bound with a variety of clips, from paper clips with removable handles, metal binder clips, staples, and other methods that do not require punching holes in the paper. Ring binders are round or "D" shaped attached to a metal spine. Some ring binders have "double lock" rings that stay locked and aligned—a three position trigger opens, unlocks and locks the rings. Plastic "GBC" (industry name) ring binders are multistrips used to fasten to specially punched paper. Flexible metal prongs are folded over in covers to attached punched paper and are filled with leaves. Accordion (typically reinforced) folded edges can be used to expand the report as papers are added. Covers have paper holding pockets on top and bottom flaps. Architectural and Engineering drawings are bound with staples, edge binders, metal screw attached plate clamps and other devices. Clip boards are fitted with a "single line contact" spring activated clamp. Leaves of other materials such as carpet samples, wall paper samples, floor covering samples, etc. are fastened together by metal fasteners, clamps etc. that are not easily assembled and disassembled. These temporary binding means are troublesome, with pinching fingers, need to punch holes, difficulty of updating materials, and papers falling out.

Permanent bookbinding, the process by which individual leaves or folded sheets are combined into one volume, is expensive and inconvenient in updating materials. Bookbinding has evolved from early costly methods when owners commissioned fine hand bindings to protect and embellish writings. The first bookbindings, made in Coptic Egyptian monasteries about the second century, were leather-covered boards tied with thongs that enclosed sewn gatherings of sheets of papyrus. Later, in the East, bindings continued to be light containers, made of leather or pasteboard, glued to sewn sheets of paper. Some Islamic folding-leather book covers were richly decorated with stamped or tooled ornament, blind or in gold leaf.

Presently, paper and other laminate binding is an encumbered process and requires much "filing" time with exhaustive preparation of paper and laminates for binding. Bookbinding on a commercial scale is a highly mechanized process requiring many types of machines. For hard cover books, flat printed sheets are first folded by machine into signatures, or units, of 16, 32, or 64 pages. They are then forwarded to a gathering machine, which collates the signatures in proper sequence into complete sets. These sets are sewed together on sewing machines. Trade books are sewed through the centerfold. Books subject to hard use, such as textbooks, are side stitched, along the side close to the back. Sidestitching makes a book harder to tear but also more difficult to keep open. Sewing is now frequently eliminated by the use of adhesive binding in which the backs of the gathered signatures are sliced off and all leaves simultaneously glued to a strip of cheesecloth or paper. The resulting book, although not as sturdy as one that is sewed, is strong enough and much less expensive to produce.

In addition to hardcover binding, paper binding and mechanical binding are also employed. Paperback books, which usually have adhesive binding instead of sewn binding, include works of short lifespan, such as popular novels, telephone directories, and mail-order catalogs. Books with mechanical binding heretofore were held together by spiral wires, rings, or snaps passing through holes punched in the leaves and the cover.

The proposed invention greatly facilitates binding; no holes are required in the leaves; and no special document preparation is required, facilitating easy assembly of papers with the capability to often "conveniently" add and remove papers.

SUMMARY OF THE INVENTION

The principal object of the invention is to enhance the state of the art for paper and other types of leaf binders. A single unit is used to hold a certain volume of paper and other leaves together. Assembly is accomplished by placing a stack of papers or leaves in main bracket, pumping air by actuating bladder to clamp papers or other leaves. Temporary disassembly for modified leaf arrangements can be easily accomplished, by opening a valve to release air, adjusting leaves and reclamping by pumping in additional air.

In an adjustable configuration, a "U"-shaped bracket with bellows is configured to attach a plurality of leaves such as paper sheets. An air pump assembly actuates an air clamping action to bind a variety of materials, such as photographs, note pads, file folders, schedule books, computer print-out paper, and even thick materials such as carpet samples, floor covering samples, and wall paper samples.

This invention will significantly reduce the time to assemble and bind papers in general office use. Papers will not require to be punched and can be bound in less time than conventional methods. Papers can be conveniently removed or added with ease, yet be firmly bound together. Books can permanently bound without adhesives.

In a nonadjustable mode, binding is achieved with tapered pins frictionally fit quickly into frustum bores. The mechanical tapered pins binding is useful for packaging commercial products with the advantage of minimum, cost effective, assembly time..

DETAILED DESCRIPTION OF THE PREFERRED EMBODIMENT

Figure 1A:
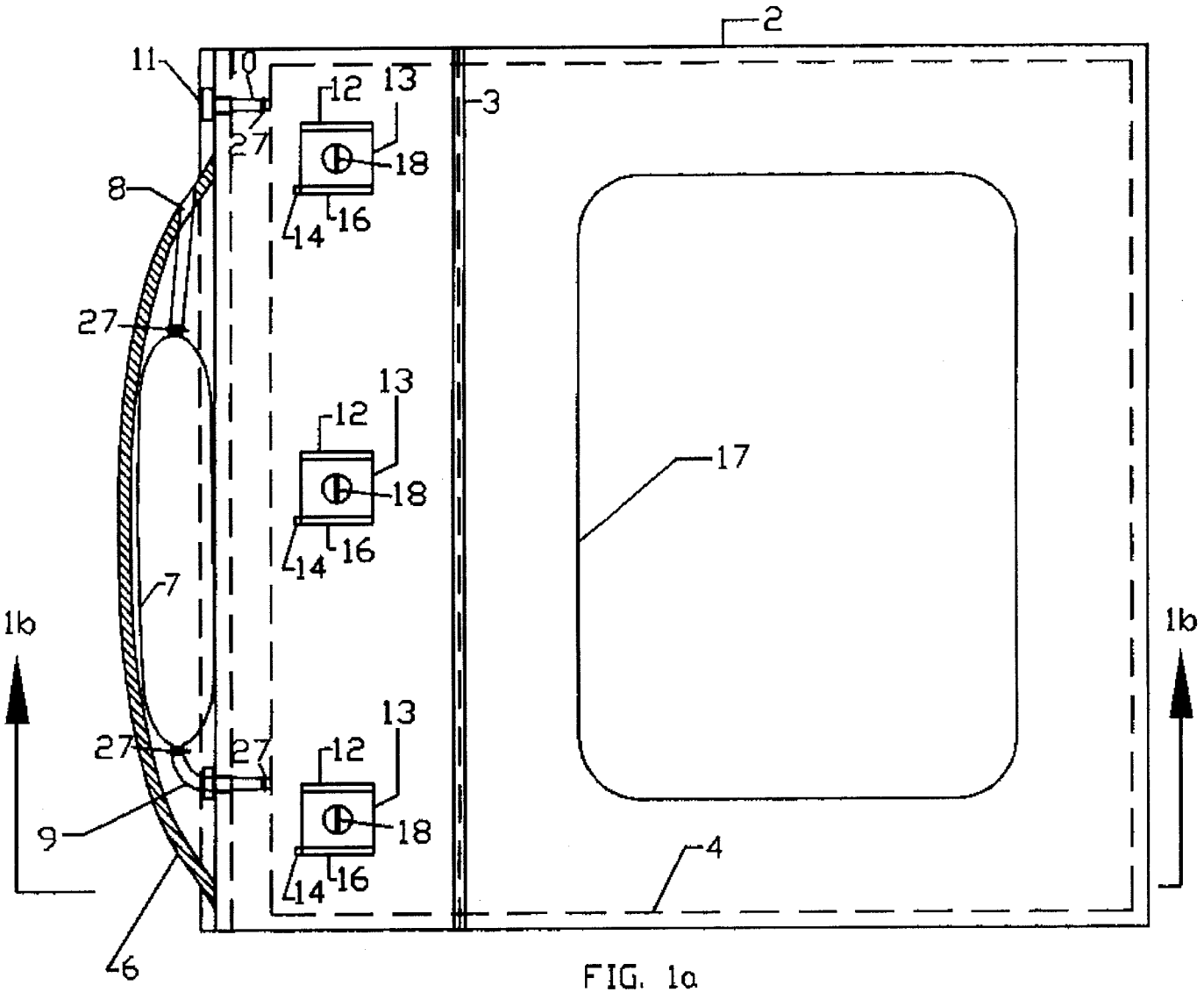
FIG. 1*a* is a top plan view of the binder showing an air pump.
Figure 1B:
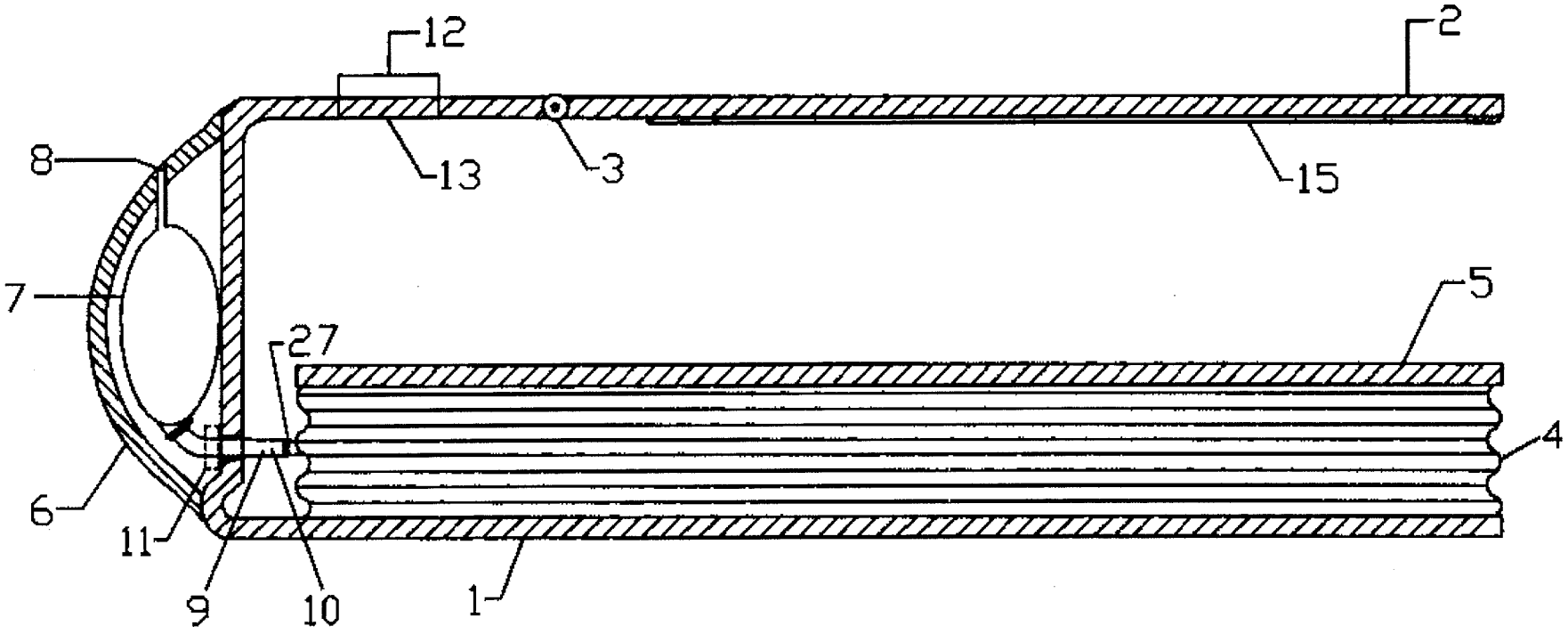
FIG. 1*b* is a side cross-section view of the binder showing the air pump and bellows.

Referring to FIG. 1, the binder of the present invention comprises a "U"-shaped bracket 1 having one long leg 1*a* for a base and a short leg 1*b* for support of clamping forces separated by a back 1*c*. A height-adjustable internal binding plate 5 is located between the two bracket legs 1*a* and 1*b*. An expandable air bellows 4 is attached between the long leg 1*b* and the internal binding plate 4 such the internal binding plate 4 is moved by the bellows toward the short leg for positioning the binding plate 4 a selective distance from the short leg and for binding leaves such as paper sheets therebetween. The binding plate 5 can also serve as a writing board.

The bellows 4 is pneumatically connected to an air pump 7 by tubes 9 and closed by check valve 11 between the bellows and the air pump 7. Tubes 9 and 10 are clamped to bellows 4 and air pump 7 and valve 11. The air pump 7 includes a bladder 6, a squeeze bulb air pump 7 with check valve 11, air intake port 8, and air connection tube 9 connected to the bellows 4. The air valve 11 attached within tubing 9 can be opened partially to release air pressure to loosen leaves bound inside bracket 1. Air pump 7 may be attached as an appendage, but is typically attached to the bracket back lc between the bladder 6 and the bracket back 1*c*. Air clamping action would be the result of pressure from the bellows 4 incident on "U" bracket short leg 1*b*.

Referring to FIG. 4, one or more clamps 16 are attached to short leg 1*a* of "U"-shaped bracket 1 which clamps comprise a rod 18 with enlarged heads 13 on each end and a torsion spring 12 around the circumference of the clamp rod 18 between the short leg 1*a* and the rod internal head biasing the rod toward the internal binding plate 5. A retractable pin 14 in the claim rod retains the assembly in the open position until the rod is removed upon which the rod releases under spring tension toward the internal binding plate 5, snapping down onto a stack of leaves stored in the binder. A hand grip can included to facilitate lifting the clamp rod for placement of the retractable pin in a clamp raised or open position.

A top cover 2 is coupled to binder bracket short leg 1*a* by means of a hinge 3. The top cover 2 may have a window 17 therein and a pocket 15 attached to a top cover underside between the cover and the binding plate to hold display materials visible through the window 17. The pocket may also be used to store other leaf materials.

Figure 2A:
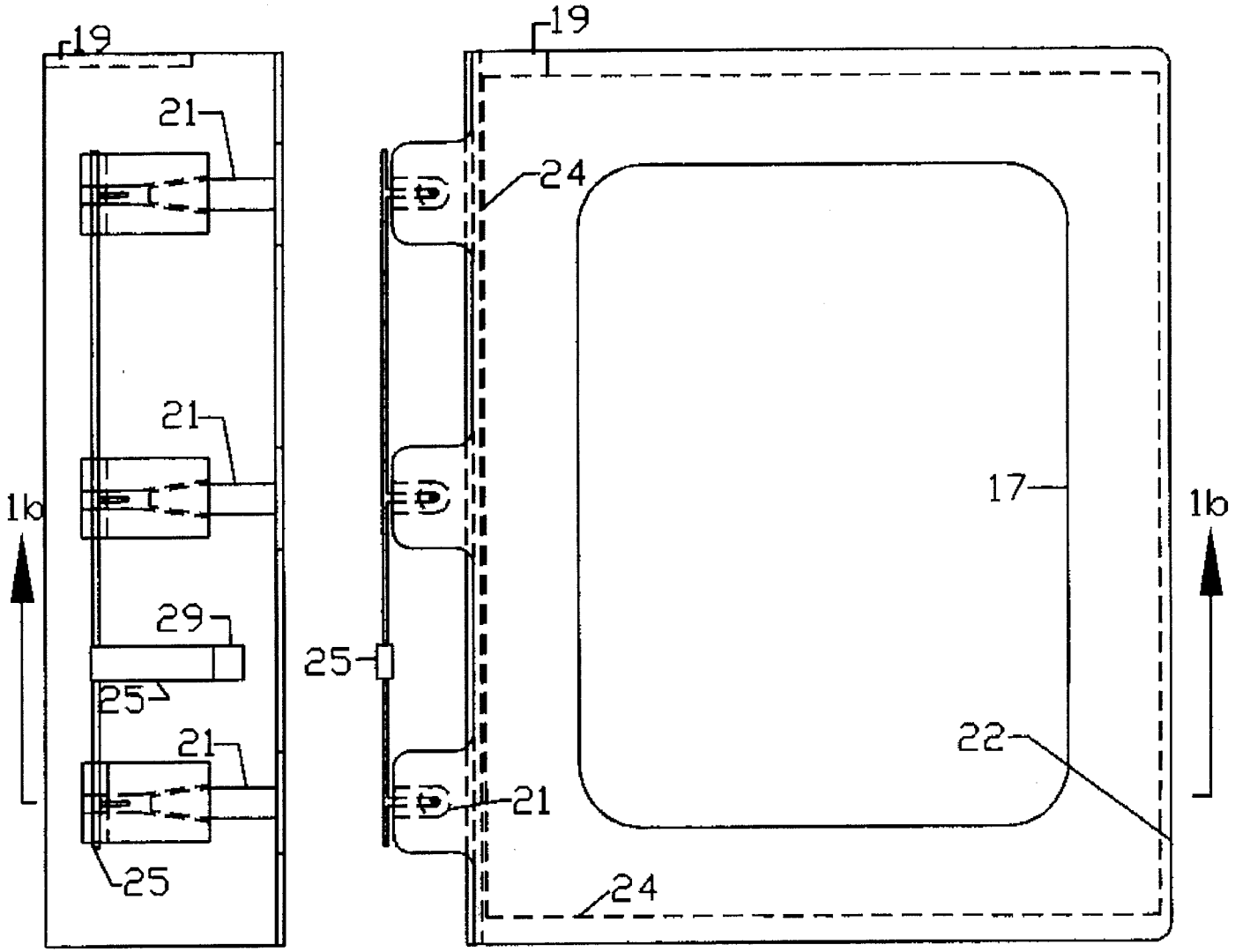
FIG. 2*a* is an end and top plan view of an alternative embodiment showing a tapered pin binding.
Figures 2B, 2C:
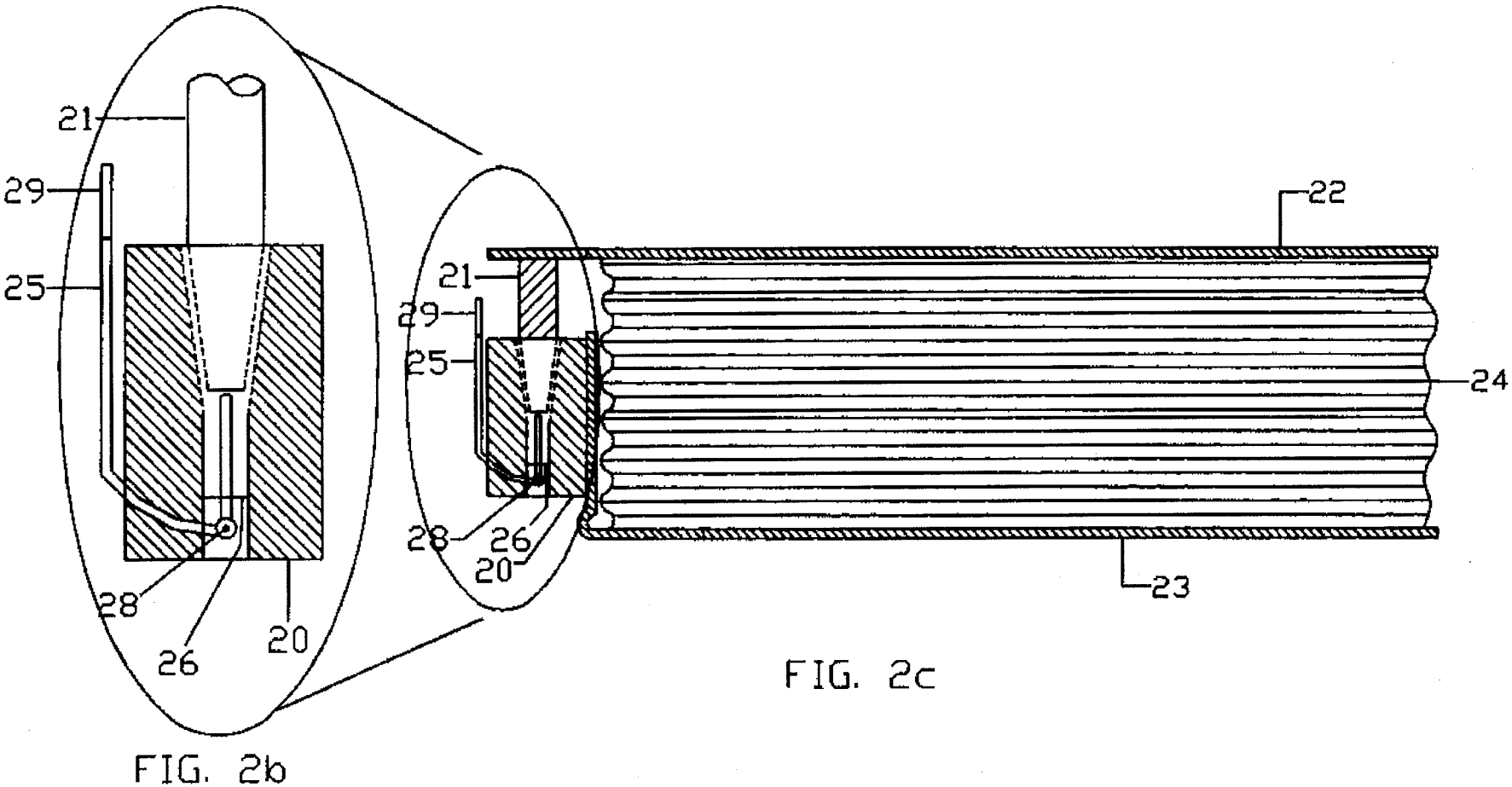
FIG. 2*b* is a side cross-section view of the binder showing the tapered pin in a block frustum bore.
FIG. 2*c* is a side cross-section view of the binder in the alternative embodiment showing materials bound therein.
Figure 3B:
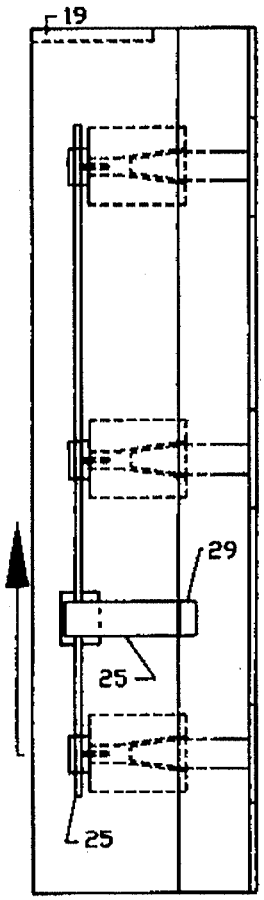
FIG. 3*b* is an end view of the alternative embodiment shown in FIG. 3*a*.
Figure 3A:
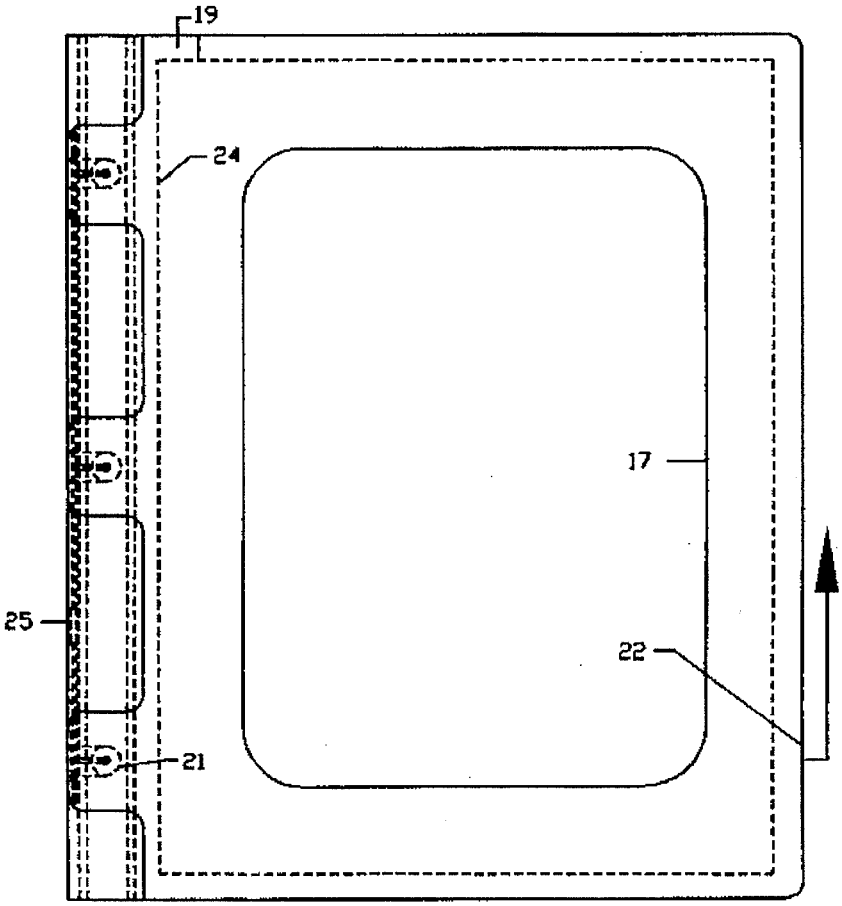
FIG. 3*a* is a top plan view of the alternative embodiment having a tapered pin binding with the pin and block enclosed.
Figure 3C:
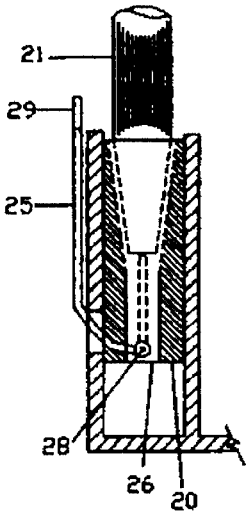
FIG. 3*c* is an enlarged cross-sectional side view of the block and pin of the alternative embodiment.
Figure 3D:
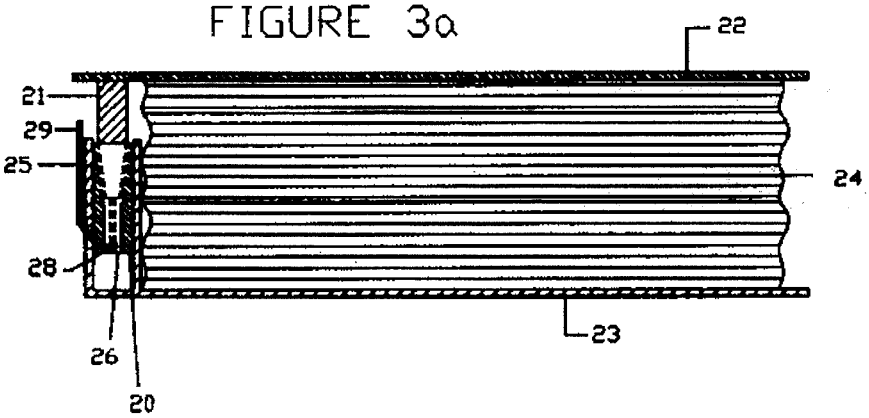
FIG. 3*d* is a cross-sectional side view of the alternative embodiment.

Referring to FIG. 2, when the binder need not be height adjustable, an alternate method for binding is by axial pressure. A plurality of blocks 20, each having a frustum bore, is attached to a bracket back 23*a* attached to the lower bracket leg 23. A plurality of tapered pins 21, matched to frictionally fit into tapered bores in block 20, are attached to upper bracket leg, or cover, 22, which when in inserted into the block bores frictionally upper and lower bracket legs 22 and 23 together, useful for more permanent binding without possible air leakage from a bellows. The tapered pins 21 are sized in length to match the height of materials being bound, with the materials being higher than the bracket back 23*a*.

To release a tapered pin 21 from the block frustum bore 30, a release lever 25 extends into the bore to the tapered pin 21 through a block hole 31. By mechanical pivot action of the release lever 25 about pivot pin 28 in the block, the release lever is moved against the tapered pin 21, and the tapered pin 21 is urged out of the the frustum bore 30.

Tapered pins 21 could have close stepped serrations for permanent locking of cover 22 and block 20 attached to base 23.

Having described the invention, what is claimed is:

1. An adjustable binder comprising a "U"-shaped bracket comprising a long leg and a short leg separated by a back member, an internal binding plate, an expandable bellows between the long leg and the internal binding plate, an air pump pneumatically connected to the bellows for pumping air into and expanding the bellows such the internal binding plate is moved by the bellows toward the short leg for positioning the binding plate a selective distance from the short leg and for binding leaves such as paper sheets therebetween, a valve between the air pump and the bellows to pneumatically open and close the bellows for retaining air in or releasing air from the bellows.

2. The binder of claim 1 further comprising a clamp assembly on the short leg having a member extendable from the short leg toward the internal binding plate under spring bias for binding leaves such as paper sheets therebetween.

3. The binder of claim 1 further comprising a moveable cover hingedly coupled to the short leg.

4. The binder of claim 3 further comprising a transparent window in the cover.

5. The binder of claim 4 further comprising a pocket attached to an underside of the cover sized to hold leaves such as paper sheets and a window in the cover through which leaves in the pocket can be seen.

6. A binder comprising a bracket comprising a lower leg and a back attached thereto, an upper bracket leg, or cover, one or more blocks each having a frustum bore attached to the bracket back, a tapered pin for each frustum bore, matched to frictionally fit into the tapered bores, and attached to the upper bracket leg, or cover, which when in inserted into the block bores frictionally bind the upper and lower bracket legs together, the tapered pins sized in length to match the height of materials to be bound, with the materials being higher than the bracket back.

7. The binder of claim 6 further comprising an upper leg, an internal binding plate, an expandable bellows between the lower leg and the internal binding plate, an air pump pneumatically connected to the bellows for pumping air into and expanding the bellows such the internal binding plate is moved by the bellows toward the upper leg for positioning the binding plate a selective distance from the upper leg and for binding leaves such as paper sheets therebetween, a valve between the air pump and the bellows to pneumatically open and close the bellows for retaining air in or releasing air from the bellows.

8. The binder of claim 6 further comprising means for mechanically releasing the tapered pin from the frustum bore.

* * * * *